US012618568B2

(12) United States Patent
Leo et al.

(10) Patent No.: US 12,618,568 B2
(45) Date of Patent: May 5, 2026

(54) COOKING HOB WITH EXTRACTOR HOOD

(71) Applicant: Elica S.p.A., Fabriano (IT)

(72) Inventors: Orlando Leo, Fabriano (IT); Manuele Martelli, Fabriano (IT)

(73) Assignee: Elica S.p.A., Fabriano (IT)

( * ) Notice: Subject to any disclaimer, the term of this patent is extended or adjusted under 35 U.S.C. 154(b) by 678 days.

(21) Appl. No.: 18/014,511

(22) PCT Filed: Jun. 1, 2021

(86) PCT No.: PCT/IB2021/054806
§ 371 (c)(1),
(2) Date: Jan. 5, 2023

(87) PCT Pub. No.: WO2022/008994
PCT Pub. Date: Jan. 13, 2022

(65) Prior Publication Data

US 2023/0258340 A1 Aug. 17, 2023

(30) Foreign Application Priority Data

Jul. 7, 2020 (IT) ..... 102020000016360

(51) Int. Cl.
*F24C 15/20* (2006.01)
*F24C 15/10* (2006.01)

(52) U.S. Cl.
CPC ..... *F24C 15/2042* (2013.01); *F24C 15/10* (2013.01); *F24C 15/2021* (2013.01)

(58) Field of Classification Search
None
See application file for complete search history.

(56) References Cited

U.S. PATENT DOCUMENTS 3,407,995 A * 10/1968 Kinsworthy ..... F04D 29/441 415/206
3,780,411 A * 12/1973 Bulin ..... F04D 25/166 415/206

(Continued)

FOREIGN PATENT DOCUMENTS

DE 202019106084 11/2019
WO WO 2012146237 11/2012

(Continued)

OTHER PUBLICATIONS

International search report, Written opinion dated Jul. 16, 2021; Application No. PCT/IB2021/054806; 14 pages.

*Primary Examiner* — Jorge A Pereiro
(74) *Attorney, Agent, or Firm* — Rankin Hill & Clark, LLP; Erik J. Overberger

(57) ABSTRACT

The present disclosure relates to a cooking hob comprising: a body configured to act as a support for the cooking activity and having an upper surface and a lower surface; at least one cooking zone located at the upper surface of the body; a suction opening formed on the upper surface; suction elements placed in fluid communication with the suction opening and configured to suck cooking fumes, said suction elements comprising a motor fan having a rotation axis which lies in a plane substantially parallel to the upper surface and extending between a first and an opposite second end along the rotation axis, the suction elements are configured to divide the cooking fumes into a first and a second portion of the cooking fumes directed respectively towards the first and the second end of the motor fan.

7 Claims, 5 Drawing Sheets

(56) References Cited

U.S. PATENT DOCUMENTS 3,856,431 A * 12/1974 Tucker ..... F04D 29/4226 415/206
3,874,191 A * 4/1975 Hudson ..... F04D 17/04 415/206
5,141,397 A * 8/1992 Sullivan ..... F04D 29/4233 415/206
5,257,904 A * 11/1993 Sullivan ..... F04D 29/4233 415/206
5,281,092 A * 1/1994 Sullivan ..... F04D 29/626 415/206
6,200,093 B1 * 3/2001 Lee ..... F04D 29/424 415/206
10,273,963 B2 4/2019 Santucci
2003/0228213 A1 * 12/2003 Bikos ..... F04D 29/424 415/101
2004/0253098 A1 * 12/2004 Hancock ..... F04D 29/424 415/206
2006/0078424 A1 * 4/2006 Lee ..... F04D 29/626 415/206
2013/0101449 A1 * 4/2013 Dickinson ..... F04D 17/162 415/198.1
2013/0101451 A1 * 4/2013 Dickinson ..... F04D 25/0606 417/423.7
2014/0079569 A1 3/2014 Uehara
2014/0290641 A1 * 10/2014 Worrell ..... F24C 15/2042 126/299 D
2018/0128495 A1 * 5/2018 Worrell ..... F24C 15/2078
2019/0032925 A1 1/2019 Gargiulo et al.
2019/0195511 A1 6/2019 Bruckbauer

FOREIGN PATENT DOCUMENTS

WO WO-2019081271 A1 * 5/2019 ..... F24C 15/2035
WO WO-2019081273 A1 * 5/2019 ..... F24C 15/2021
WO WO 2019197055 10/2019

* cited by examiner

COOKING HOB WITH EXTRACTOR HOOD

FIELD OF THE DISCLOSURE

The present disclosure relates to a cooking hob according to the preamble to claim 1.

Particularly, but not exclusively, the present disclosure relates to a cooking hob incorporating a hood of a type commercially known as a down-draft hood.

BACKGROUND

The hoods for domestic environments are now installed in all kitchens present in the homes, as their usefulness in extracting aeriform due to food preparation, i.e., cooking vapours, is now undisputed. It is therefore becoming increasingly important to have hoods for domestic environments that are actually able to eliminate the cooking vapours that are produced during the phases of food preparation.

To this end, hoods have been developed which are able to both suck and discharge the sucked air outside the home by means of suction elements and filter it and introduce it back into the domestic environment.

Among the various hoods on the market there are also the so-called down-draft hoods, which are often integrated in a cooking hob or alternatively in the top of a kitchen cabinet. In particular, the down-draft hood is configured to generate a downward current that is greater than the upward speed of the cooking vapour so that this vapour is sucked towards the cooking hob itself in a vertical downward direction.

For example, a cooking hob comprising a body configured to act as a support for the cooking activity and having an upper surface and an opposite lower surface is known in the state of the art. This cooking hob further comprises at least one cooking zone located at the upper surface of the body.

In addition, the cooking hob of the prior art comprises a suction opening formed in the upper surface of the body and suction elements placed in fluid communication with the suction opening and configured to suck cooking fumes.

The suction elements of the prior art comprise at least one electric motor configured to generate a flow of cooking fumes through the suction opening. This electric motor has a rotation axis which acts in a plane orthogonal to the upper surface of the body. In other words, the rotation axis of the electric motor is essentially vertical, i.e., perpendicular to the walking surface of a domestic environment in which such a cooking hob is installed.

Examples of such cooking hobs of prior art are known under the trade names of Bora Pure® and Bora Basic® and comprise a single single-suction electric motor and a pair of single-suction electric motors, respectively.

An example of a cooking hob in accordance with the preamble of claim 1 is shown in document DE 20 2019 106084 U1.

Problem of the Prior Art

Disadvantageously, during the operation of the cooking hobs of prior art, and in particular during the suction of cooking fumes through the suction opening, the suction elements produce a noise which is particularly annoying for the user.

The value of the noise generated during operation has become a parameter to which the manufacturer and/or the user pay great attention, so much so that the energy label must indicate the relative decibel value produced at a given operating speed of the electric motor.

For this reason, there is a strong demand from appliance manufacturers for cooking hobs comprising increasingly quiet suction elements.

SUMMARY OF THE DISCLOSURE

In this context, the technical objective underlying the present disclosure is to provide a cooking hob which obviates the drawbacks in the prior art mentioned above.

In particular, it is an object of the present disclosure to make available a cooking hob comprising suction elements which, when operated for suctioning cooking fumes, produce a lower noise level than those of the prior art.

The technical task mentioned and the objects specified are substantially achieved by a cooking hob comprising the technical features set forth in one or more of the appended claims.

Advantages of the Disclosure

Thanks to a preferred embodiment of the disclosure, it is possible to suck the cooking fumes produced by cooking food while producing an acceptable level of suction noise for the user.

Thanks to the preferred embodiment of the disclosure, it is also possible to divide the cooking fumes within the suction elements, thereby enabling a more efficient filtration of the cooking fumes, i.e., a better removal of the fats and vapours present within such cooking fumes.

LIST OF FIGURES

Further characteristics and advantages of the present disclosure will become more apparent from the approximate and thus non-limiting description of a preferred, but not exclusive, embodiment of a cooking hob, as illustrated in the accompanying drawings, of which:

DETAILED DESCRIPTION

Figure 1:
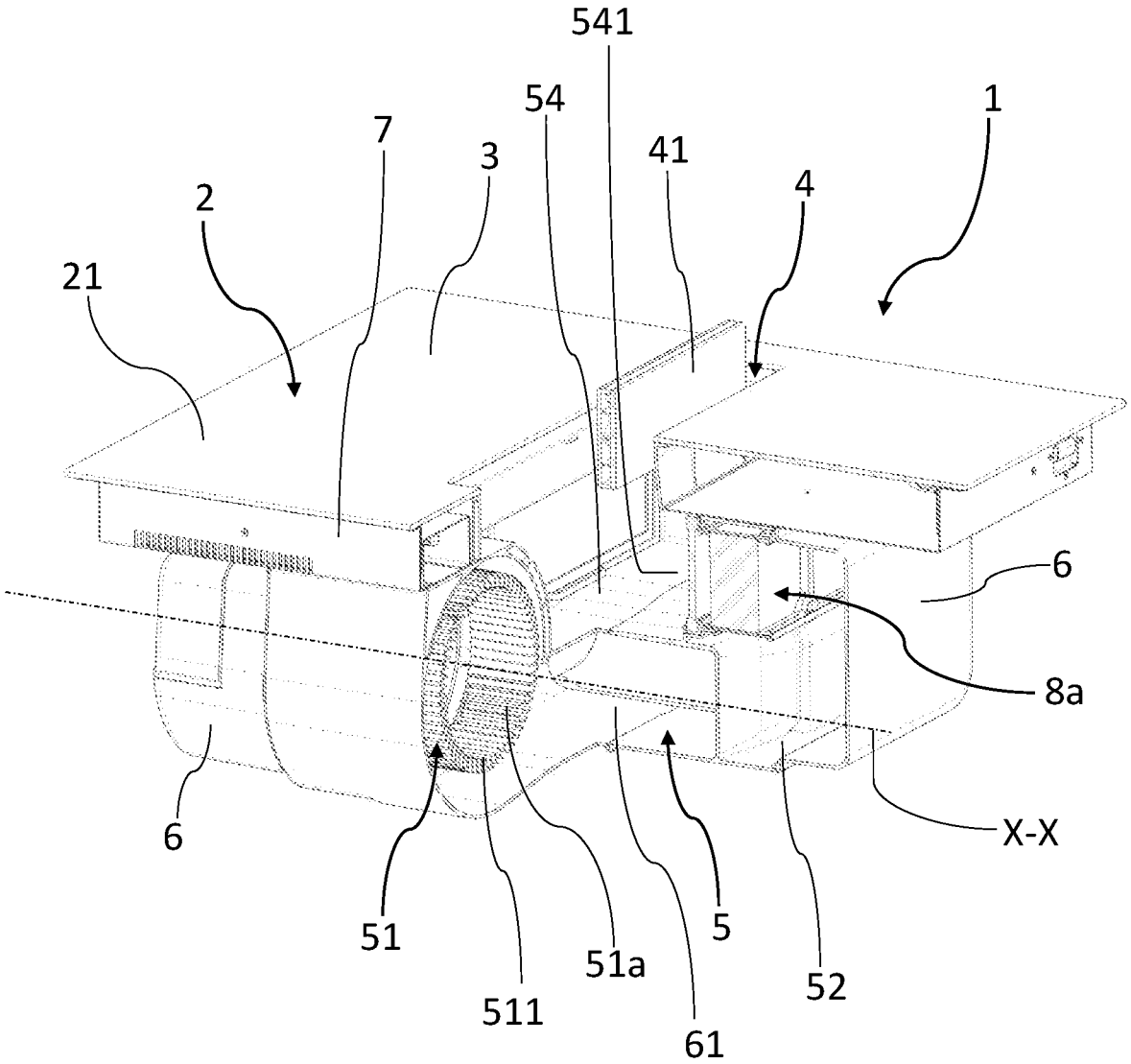
FIG. 1 is a partially sectional perspective view of the cooking hob in accordance with the present disclosure.
Figure 2:
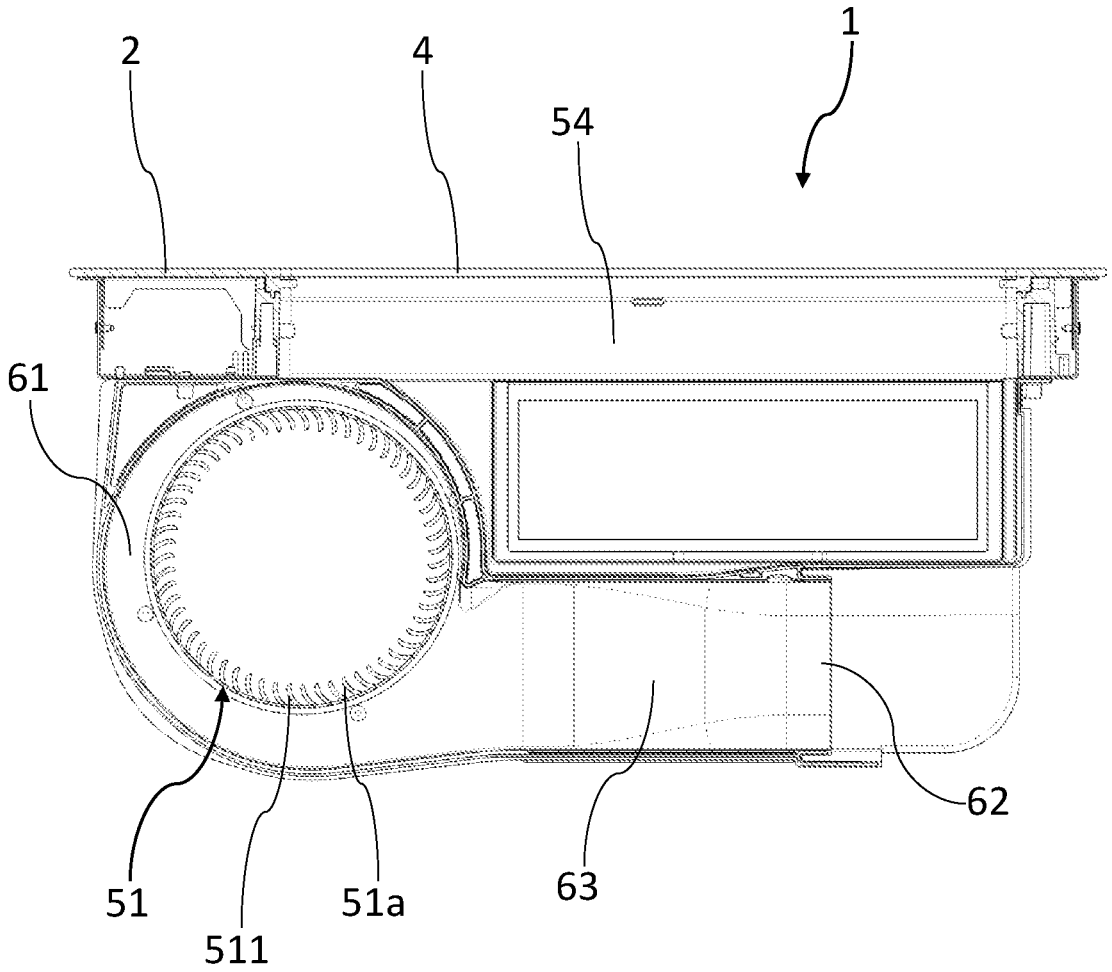
FIG. 2 is a sectional side view of the cooking hob in FIG. 1.
Figure 3:
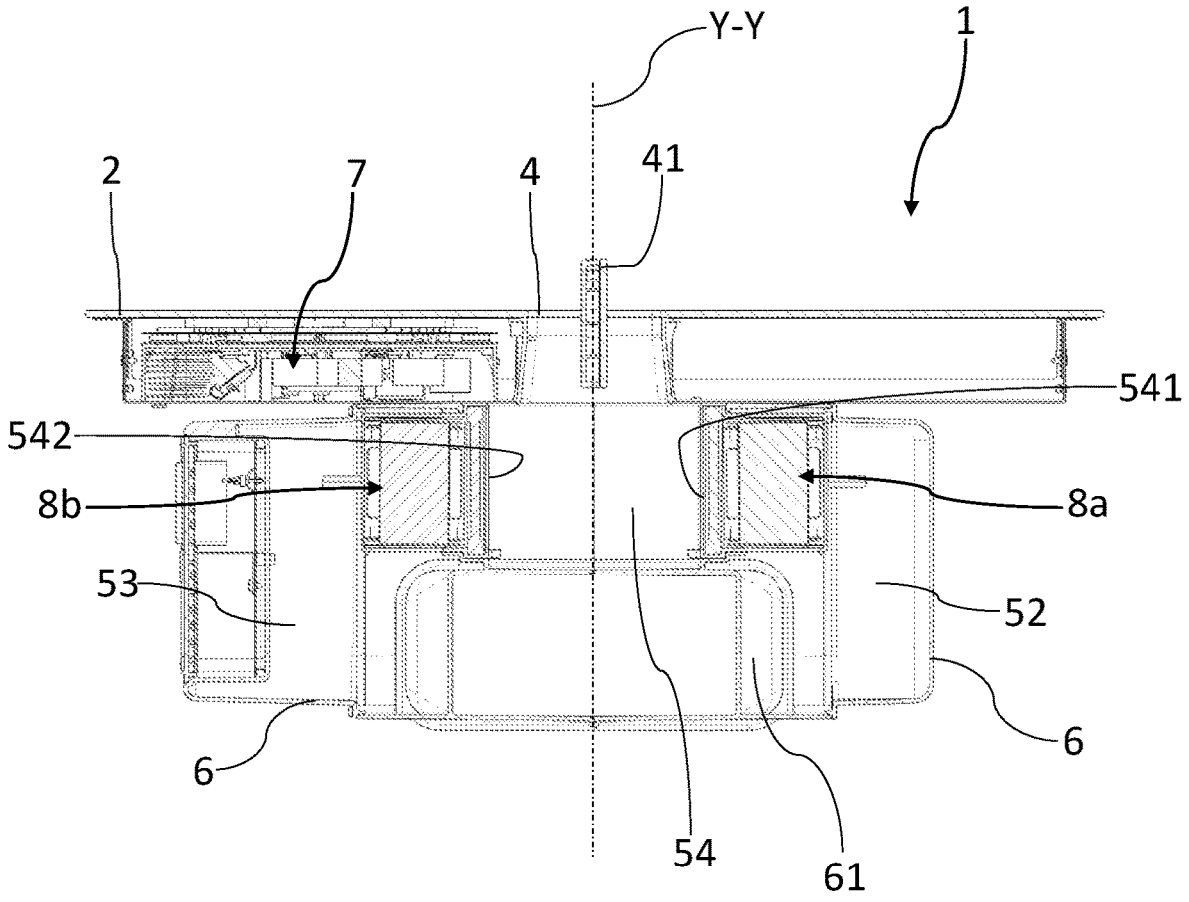
FIG. 3 is a sectional front view of the cooking hob in FIG. 1.
Figure 4:
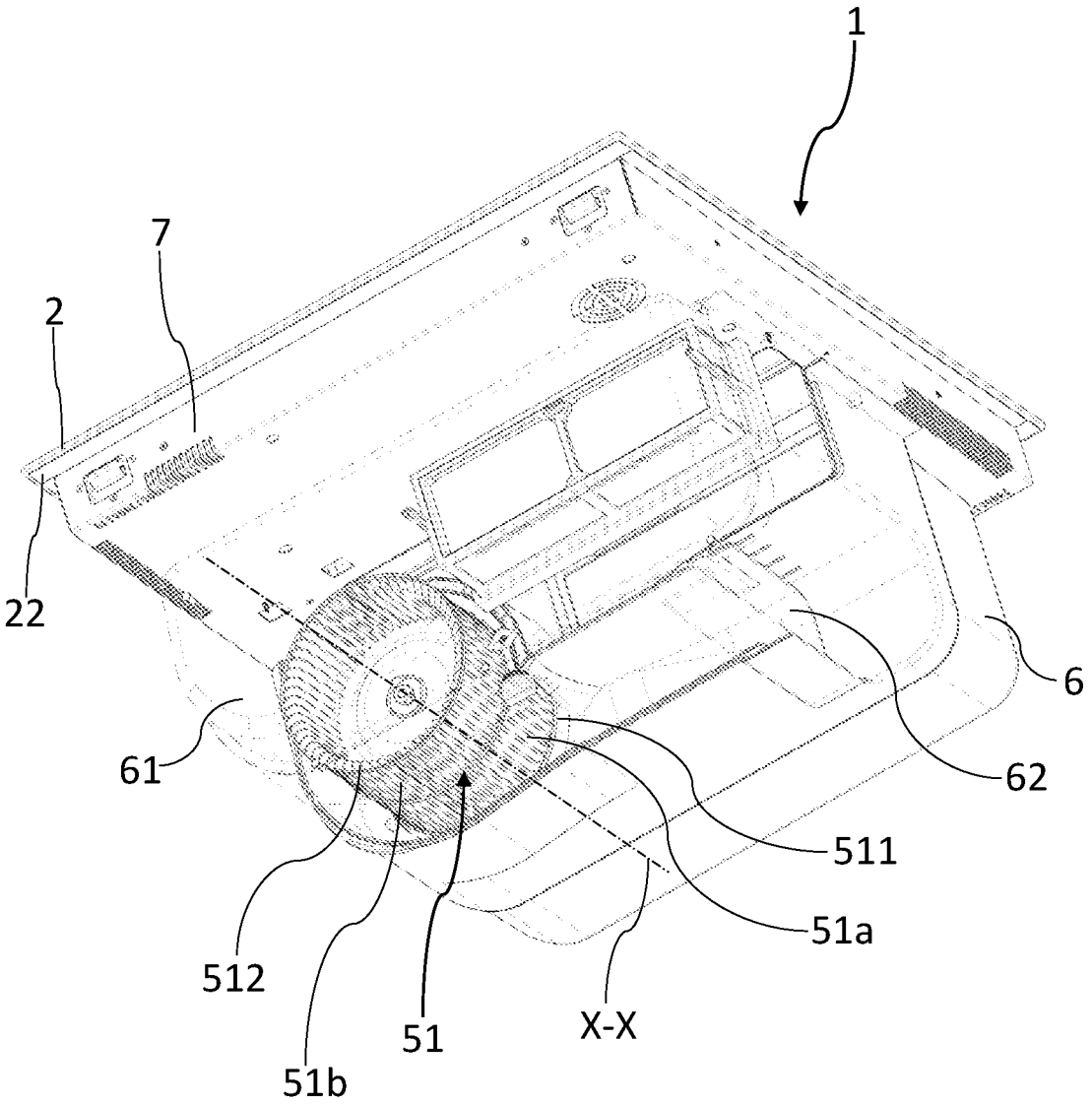
FIG. 4 is a perspective view from below of the cooking hob from FIG. 1 with a covering casing removed.

Even when not explicitly highlighted, the individual features described with reference to the specific embodiments must be considered as accessories and/or exchangeable with other features, described with reference to other embodiments.

With particular reference to the attached figures, a cooking hob is indicated by the number 1.

Said cooking hob 1 comprises a body 2 configured to act as a support for the cooking activity.

In fact, as will become clearer in the following, the containers containing the food to be cooked are placed and suitably heated on this body 2.

According to one aspect, the body is preferably square or rectangular in shape and has a predetermined thickness.

This body 2 has an upper surface 21 and a lower surface 22.

Preferably, the upper surface 21, i.e., the surface intended to act as a support for the containers containing the food to be cooked, is flat.

The upper surface 21 and the lower surface 22 are opposite each other along a longitudinal direction Y-Y.

Preferably, in use, i.e., when the cooking hob 1 is properly installed in a room (not illustrated in the appended figures), such as the kitchen of a domestic dwelling, this longitudinal direction Y-Y is substantially vertical, i.e., it is perpendicular to the walking surface of the room in which the cooking hob 1 is installed. Still in use, the lower surface 22 of body 2 faces the walking surface.

The cooking hob 1 comprises at least one cooking zone 3 located at the upper surface 21 of the body 2. The container containing the food to be cooked is placed on the cooking hob 1 at cooking zone 3.

Furthermore, the cooking hob 1 comprises at least one suction opening 4 formed on said upper surface 21 and suction elements 5 placed in fluid communication with said suction opening 4 and configured to suck in cooking fumes. These suction elements 5 are configured to suck in the cooking fumes produced by cooking the food through this suction opening 4.

Preferably, the cooking hob 1 comprises a door 41 positioned at the suction opening 4. This door 41 is switchable between a first position, in which it allows cooking fumes to be sucked in through the suction opening 4, and a second position, in which the door 41 closes the suction opening 4.

The suction elements 5 comprise a motor fan 51 having a rotation axis X-X which lies in a plane parallel to the upper surface 21.

In particular, when the cooking hob 1 is correctly installed in a room, this rotation axis X-X is parallel to both the upper surface 21 and the walking surface of the room in which the cooking hob 1 is installed, i.e., the rotation axis X-X is orthogonal to the longitudinal axis Y-Y.

In the present description, the term "lies in a plane parallel to the upper surface 21" means that the rotation axis X-X of the motor fan 51 is substantially parallel to the surface 21, i.e., that the rotation axis X-X lies in a plane that can provide for a variation of +/−5° with respect to the condition of parallelism. This variability of the parallelism condition may be due, for example, to constructional reasons of the motor fan 51, to assembly reasons or to a design choice.

The motor fan 51 extends between a first 511 and an opposite second end 512 along the rotation axis X-X.

The suction elements 5 are configured to divide the cooking fumes into a first and a second portion of the cooking fumes directed respectively towards the first 511 and the second end 512 of the motor fan 51.

It should be noted that due to the arrangement of the rotation axis X-X of the motor fan 51 and to the division of the cooking fumes operated by the suction elements 5, the suction noise produced by the suction elements 5 is lower than the corresponding suction noise produced by the cooking hobs of the prior art.

Figure 5:
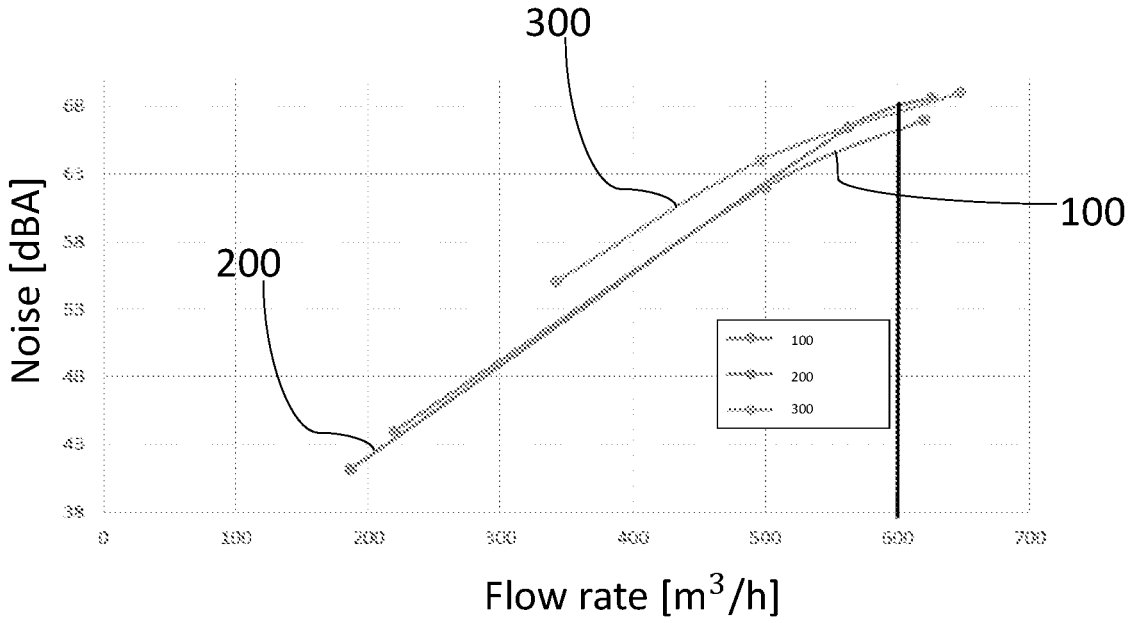
FIG. 5 is a graph comparing the noise produced by the cooking hob of FIG. 1 with the noise produced by cooking hobs of prior art.

In fact, with particular reference to FIG. 5, this figure shows a graph with the flow rate of sucked cooking fumes shown on the abscissa axis and the intensity of the produced noise shown on the ordinate axis.

In particular, said graph shows a first curve 100 relative to the cooking hob 1 in accordance with the present disclosure, a second curve 200 relative to a cooking hob of the prior art comprising a single single-suction electric motor, and a third curve 300 relative to a cooking hob of the prior art comprising a pair of single-suction electric motors.

As can be seen from said graph shown in FIG. 5, for flow rate values of the sucked cooking fumes equal to about 600 $m^3/h$, that is, for a flow rate value of the sucked cooking fumes typical of a normal use of the suction elements of a cooking hob, the noise produced by the cooking hob 1 in accordance with the present disclosure is equal to about 67 dBA, while the noises produced by the cooking hob of the prior art comprising a single single-suction motor fan and by the cooking hob of the prior art comprising a pair of single-suction motor fans are about 68.6 dBA and 69 dBA, respectively.

The difference in value of the cooking hob in accordance with the present disclosure is therefore equal to 1.6 dBA compared to the cooking hob provided with a single single-suction motor fan and to 2 dBA compared to the cooking hob having a double single-suction motor fan.

These differences indicate a significant decrease in the noise perceived by the user with the same volume of air sucked in per hour, thus making the cooking hob 1 quieter than the state of the art.

In accordance with a preferred embodiment of the disclosure, the suction elements 5 comprise a first 52 and a second suction duct 53 in fluid communication with the suction opening 4 and respectively with the first 511 and second end 512 of the motor fan 51.

The motor fan 51 is configured to suck the first portion of the cooking fumes through the first suction duct 52 and the second portion of the cooking fumes through the second suction duct 53.

Preferably, the fluid dynamic resistance of the first suction duct 52 corresponds to the fluid dynamic resistance of the second suction duct 53. More preferably, the fluid dynamic resistance of the first suction duct 52 is substantially equal to the fluid dynamic resistance of the second suction duct 53. In the maximum preferred case, the fluid dynamic resistance of the first suction duct 52 is equal to the fluid dynamic resistance of the second suction duct 53.

Still preferably, the length and the passage section of the cooking fumes of the first 52 and of the second suction duct 53 correspond to each other.

Thanks to the correspondence between the fluid dynamic resistance of the first suction duct 52 and the fluid dynamic resistance of the second suction duct 53, the distribution of the cooking fumes between the first 52 and the second suction duct 53 is symmetrical. In other words, the first portion of the cooking fumes corresponds to the second portion of the cooking fumes. In other words, the cooking fume flow rate in the first suction duct 52 corresponds to the cooking fume flow rate in the second suction duct 53.

In order to obtain the desired suction, the motor fan 51 comprises an electric motor and an impeller.

According to one aspect, the impeller is mechanically connected to the shaft of the electric motor. In this way, the rotation of the motor shaft of the electric motor causes the impeller to rotate and to thus be able suck the cooking fumes.

The impeller, which preferably consists of a single piece made by moulding, comprises a first half-part 51*a* and a second half-part 51*b* arranged at the first 511 and the second end 512 of the motor fan 51, respectively.

The first half-part 51*a* of the impeller is configured to suck the first portion of the cooking fumes through the first suction duct 52, and the second half-part 51*b* of the impeller is configured to suck the second portion of the cooking fumes through the second suction duct 53.

In accordance with the preferred embodiment of the disclosure, the cooking hob 1 comprises a pair of covering casings (or frames) 6 connected to each other so as to define a housing 61. The motor fan 51 is arranged in the housing 61. The motor fan 51 is therefore supported and protected by the covering casings 6.

According to one aspect, the covering casings 6 define the first 52 and the second suction duct 53. In other words, the shape and dimensions of the first 52 and second suction duct 53 are defined by the coupling between the covering casings 6.

In accordance with the preferred embodiment of the disclosure, the cooking hob 1 comprises an operating unit 7 for the operation of the cooking hob 1, for the control thereof and for the outflow of cooking vapours through first 52 and the second suction duct 53.

The operating unit 7 is further configured to contain at least one heating element capable of heating the at least one cooking zone 3 and a command and control electronics of the cooking hob 1.

By means of the operating unit 7 the user can selectively adjust the heating of the cooking zone 3 and operate the suction elements 5. In other words, by means of the operating unit 7 it is possible to operate the motor fan 51 and to adjust the rotation speed of said motor fan 51.

The operating unit 7 is per se known to the person skilled in the art and will therefore not be described further.

This operating unit 7 is arranged below the body 2 of the cooking hob 1. Preferably, this operating unit 7 is constrained to the lower surface 22 of the body 2.

According to an aspect, the covering casings 6 are arranged and constrained below the operating unit 7 and at least one covering casing 6 is reversibly constrained to the operating unit 7 to allow access to the housing 61. By removing one of the covering casings 6, it is possible to carry out maintenance activities on, for example, the motor fan 51. In other words, at least one covering casing 6 is reversibly constrained to the operating unit 7 to allow the motor fan 51 to be reached.

In accordance with the preferred embodiment of the disclosure, a covering casing 6 is reversibly constrained to the operating unit 7, while the other covering casing 6 is stably constrained to the operating unit 7.

In an alternative embodiment both covering casings can be provided as reversibly constrained to the operating unit 7.

In the portion of the housing 61 close to the covering casing 6 stably constrained to the operating unit 7, the power supply unit (not illustrated in the accompanying figures) of the motor fan 51 is housed.

Still in accordance with the preferred embodiment of the disclosure, the cooking hob 1 comprises a first 8*a* and a second filtering group 8*b* arranged in the housing 61 upstream of the respective first 52 and second suction duct 53 so as to filter the fats and the vapours that are present respectively in the first and second portion of the cooking fumes. Advantageously, the first and second portions of the cooking fumes are filtered separately, thus allowing a better filtration efficiency of the cooking fumes.

Preferably, the first 8*a* and the second filtering group 8*b* comprise respectively a grease filter comprising a metal grid and an activated carbon filter. The grease filter and the activated carbon filter are familiar to the person skilled in the art and will therefore not be described further.

In accordance with the preferred embodiment of the disclosure, the suction elements 5 comprise a suction chamber 54 in fluid communication with the suction opening 4. This suction chamber 54 is located downstream of suction opening 4. Preferably, the suction chamber 54 is defined by the operating unit 7 and the covering casings 6.

Said suction chamber 54 has a first 541 and a second outlet 542 in fluid communication, respectively with the first 52 and the second suction duct 53. The suction chamber 54 is therefore located upstream of the first 52 and the second suction duct 53. In other words, the suction chamber 54 is interposed between the suction opening 4 and the first 52 and the second suction duct 53.

The separation of the cooking fumes between the first and the second portion of the cooking fumes occurs at the suction chamber 54. In fact, the first portion of the cooking fumes passes from the suction chamber 54 to the first suction duct 52 through the first outlet 541, while the second portion of the cooking fumes passes from the suction chamber 54 to the second suction duct 53 through the second outlet 542. Preferably, the surface extent of the first outlet 541 corresponds to the surface extent of the second outlet 542.

The first 8*a* and the second filtering group 8*b* are placed at the first 541 and second outlet 542 of the suction chamber 54, respectively. Preferably, the first 8*a* and the second filtering group 8*b* are interposed between the suction chamber 54 and, respectively, the first 52 and the second suction duct 53.

Still in accordance with the preferred embodiment of the disclosure, the covering casings 6 when constrained define an exhaust outlet 62 in fluid communication with the motor fan 51. The suction elements 5 are configured to expel the cooking fumes through this exhaust outlet 62. The cooking fumes sucked through the suction opening 4 are then removed through the exhaust outlet 62.

Preferably, the covering casings 6, when constrained, define an exhaust duct 63. Said exhaust duct 63 is configured to place the motor fan 51 and the exhaust outlet 62 in fluid communication. In other words, this exhaust duct 63 is located downstream of the motor fan 51 and upstream of the exhaust outlet 62.

In accordance with the preferred embodiment of the disclosure, the path of the cooking fumes from the suction opening 4 to the exhaust outlet 62 provides for the passage of the cooking fumes in the suction chamber 54 through the suction opening 4, dividing the cooking fumes into a first and a second portion of the cooking fumes at the suction chamber 54, the reaching of the first end 511 of the motor fan 51 by the first portion of the cooking fumes through the first suction duct 52, the reaching of the second end 512 of the motor fan 51 by the second portion of the cooking fumes through the second suction duct 53 and, finally, the rejoining of the first and second portion of the cooking fumes in the exhaust duct 63, before expulsion through the exhaust outlet 62.

According to one aspect, the exhaust outlet 62 is connectable to an outlet duct (not illustrated) of the room in which the cooking hob 1 is installed in order to let the cooking fumes outflow outside of that room.

Obviously, a person skilled in the art, for the purpose of satisfying contingent and specific requirements, can make numerous modifications to the variants described above, all therefore contained within the scope of protection as defined in the following claims.

The invention claimed is:

1. A cooking hob comprising:

a body configured to act as a support for the cooking activity and having an upper surface and a lower surface;

at least one cooking zone located at the upper surface of the body;

a suction opening formed on said upper surface;

suction elements placed in fluid communication with said suction opening (4) and configured to suck cooking fumes;

wherein:

said suction elements comprise a motor fan having a rotation axis, said motor fan extending between a first and a opposite second end along said rotation axis;

said suction elements being configured to divide the cooking fumes into a first and a second portion of the cooking fumes directed respectively towards the first and the second end of the motor fan;

the axis of rotation lies in a plane parallel to the upper surface the suction elements comprise a first and a second suction duct in fluid communication with the suction opening and respectively with the first and the second end of the motor fan, the fluid dynamic resistance of said first suction duct being substantially equal to the fluid dynamic resistance of said second suction duct; said motor fan being configured to suck the first portion of the cooking fumes through said first suction duct and the second portion of the cooking fumes through said second suction duct;

the cooking hob comprises an operating unit for the operation of the cooking hob, for the control thereof and for the outflow of cooking vapors through said first and second suction duct and configured to contain at least one heating element capable of heating the at least one cooking zone and a command and control electronics of the cooking hob, said operating unit being arranged below said body of the cooking hob;

the cooking hob comprises a pair of covering casings connected to each other so as to define a housing, said motor fan being arranged in the housing, said pair of covering casing defining the first and the second suction duct, wherein the covering casings are arranged and constrained below said operating unit and at least one covering casing is reversibly constrained to said operating unit to allow the motor fan to be reached.

2. The cooking hob according to claim 1, comprising a pair of covering casings connected to each other so as to define a housing, said motor fan being arranged in the housing, said pair of covering casing defining the first and the second suction duct.

3. The cooking hob according to claim 2, wherein said motor fan comprises an electric motor and an impeller, said impeller comprising a first half-part and a second half-part arranged at the first and the second end of said motor fan respectively.

4. The cooking hob according to claim 2, wherein said covering casings when constrained define an exhaust outlet in fluid communication with the motor fan, the suction elements being configured to expel the cooking fumes through said exhaust outlet.

5. The cooking hob according to claim 1, comprising:

comprising a pair of covering casings connected to each other so as to define a housing, said motor fan being arranged in the housing, said pair of covering casing defining the first and the second suction duct;

a first and a second filtering group arranged in the housing upstream of the respective first and second suction duct so as to filter the fats and the vapours that are present respectively in the first and second portion of the cooking fumes.

6. The cooking hob according to claim 5, wherein said first and second filtering group comprise respectively a grease filter comprising a metal grid and an activated carbon filter.

7. The cooking hob according to claim 5, wherein the suction elements comprise a suction chamber in fluid communication with the suction opening, said suction chamber having a first and a second outlet in fluid communication, respectively with the first and with the second suction duct, the first and the second filtering group being placed at the first and the second outlet respectively.

* * * * *